United States Patent [19]

Kinouchi et al.

[11] Patent Number: 4,719,988

[45] Date of Patent: Jan. 19, 1988

[54] MUFFLER

[75] Inventors: Sosuke Kinouchi, Kakogawa; Syuziro Shigemoto, Hyogo; Wataru Kanazawa, Kakogawa, all of Japan

[73] Assignee: Kawasaki Jukogyo Kabushiki Kaisha, Kobe, Japan

[21] Appl. No.: 879,306

[22] Filed: Jun. 27, 1986

[30] Foreign Application Priority Data

Jul. 8, 1985 [JP] Japan ..... 60-150822

[51] Int. Cl.[4] ..... F01N 1/08

[52] U.S. Cl. ..... 181/273; 181/265; 181/272

[58] Field of Search ..... 181/240, 243, 255, 266, 181/272, 273, 265

[56] References Cited

U.S. PATENT DOCUMENTS 4,038,820 8/1977 Tsukamoto ..... 181/273 X
4,149,611 4/1979 Taguchi ..... 181/252
4,416,350 11/1983 Hayashi ..... 181/272

*Primary Examiner*—Benjamin R. Fuller
*Attorney, Agent, or Firm*—Leydig, Voit & Mayer

[57] ABSTRACT

The muffler comprises a main sound arresting chamber formed in the interior of an outer cylinder of the muffler and a bracket fixedly secured to the outer surface of the outer cylinder for mounting the muffler on a body of a motorcycle. The muffler is provided with an auxiliary sound arresting chamber formed in the interior of the bracket and communicating with the main sound arresting chamber through a connecting passage so as to increase the total volume of the sound arresting chamber, thereby permitting the output of the engine of the motorcycle to be enhanced while the sound arresting effect on the exhaust gas is improved. The main sound arresting chamber may be divided into an upstream side main sound arresting chamber portion and downstream side main sound arresting chamber portions by partition means and the auxiliary sound arresting chamber portion communicates with the upstream main sound arresting chamber portion. The connecting passage may be in the form of a plurality of small diameter holes. The outer cylinder may be provided with plating liquid drain holes communicating with an end of the auxiliary sound arresting chamber so as to expedite drain of the plating liquid during the plating process, the plating liquid drain holes being blocked by a baffle member incorporated in the interior of the outer cylinder.

8 Claims, 3 Drawing Figures

MUFFLER

BACKGROUND OF THE INVENTION

The present invention relates to a muffler for use in a motorcycle.

In general, mufflers for a motorcycle are arranged at the respective lateral sides of the body of the motorcycle and each of the mufflers is fixedly secured to the body through a bracket which is secured to the outer cylinder of the respective muffler. When the volume of a sound arresting chamber within the muffler is made large, the performance of the engine and the sound arresting effect of the muffler can be enhanced, and, particularly, when the first sound arresting chamber at the side of the exhaust pipe, i.e. the upstream side is made large, the performance of the engine is enhanced.

On the other hand, since the space allowed to be occupied by the muffler in a motorcycle is greatly limited it is difficult to make the volume of the muffler large thereby resulting in difficulties to sufficiently enhance the performance of the output of the engine and the sound arresting effect of the muffler.

SUMMARY OF THE INVENTION

In order to solve the above described difficulties, the present invention provides a muffler wherein a main sound arresting chamber is formed in the interior of an outer cylinder of the muffler and a bracket for mounting the muffler on the body of the motorcycle is fixedly and sealingly secured at a peripheral edge portion thereof to the outer surface of the outer cylinder, the muffler being characterized in that an auxiliary sound arresting chamber is formed in the interior of the bracket which communicates with an upstream portion of the main sound arresting chamber through means for fluid communication between the main and auxiliary sound arresting chambers, such as a connecting passage.

According to an embodiment of the present invention, partitions are provided in the interior of the outer cylinder of the muffler to divide the main sound arresting chamber into an upstream side main sound arresting chamber portion and downstream side main sound arresting chamber portions, and the bracket is fixedly secured to the wall of the outer cylinder surrounding the upstream side main sound arresting chamber portion, and the connecting passage is formed by holes formed in the above described wall of the outer cylinder.

The present invention also provides a muffler wherein a main sound arresting chamber is formed in the interior of an outer cylinder of the muffler, and a bracket for mounting the muffler on the body of a motorcycle is fixedly secured to the outer surface of the outer cylinder, the muffler being characterized in that an auxiliary sound arresting chamber is formed in the interior of the bracket, and the main sound arresting chamber is communicated with the auxiliary sound arresting chamber through a plurality of small diameter holes.

The present invention further provides a muffler wherein a main sound arresting chamber is formed in the interior of an outer cylinder of the muffler and a bracket for mounting the muffler on the body of the motorcycle is fixedly secured to the outer surface of the outer cylinder, the muffler being characterized in that an auxiliary sound arresting chamber is formed in the interior of the bracket, and the main sound arresting chamber is connected to the auxiliary sound arresting chamber through a connecting passage, plating liquid drain holes being formed in the outer cylinder communicating with an end of the auxiliary sound arresting chamber, and the plating liquid drain holes being closed by baffle members incorporated in the interior of the outer cylinder.

With the above described construction, a sound arresting chamber having a large volume as a whole is formed by the main sound arresting chamber in the interior of the outer cylinder and the auxiliary sound arresting chamber in the interior of the bracket. Thus, the output of the engine is increased, while the noise of the exhaust gas is sufficiently arrested. Particularly, when the auxiliary sound arresting chamber is connected to the upstream side sound arresting chamber, the output of the engine is greatly increased, because the volume of the upstream side sound arresting chamber is increased as a whole.

Further, when the auxiliary sound arresting chamber is formed in the interior of the bracket and the auxiliary sound arresting chamber is connected to the main sound arresting chamber through a plurality of small diameter holes, the sound arresting effect is further enhanced.

Further, when the auxiliary sound arresting chamber communicating with the main sound arresting chamber is formed in the interior of the bracket and the plating liquid drain holes are provided communicating with the end of the auxiliary sound arresting chamber, the efficiency of discharging the processing liquids from the auxiliary sound arresting chamber during the plating process is enhanced and the mixing of various processing liquids is prevented so that deterioration of the processing liquids can be prevented. Since the plating liquid drain holes are closed by the baffle members incorporated in the interior of the outer cylinder, the exhaust gas is prevented from passing through the plating liquid drain holes so that the output of the engine is increased in the like manner as in the case no plating liquid drain holes are provided, while a high sound arresting effect is maintained.

DETAILED DESCRIPTION OF THE PREFERRED EMBODIMENT

Figure 1:
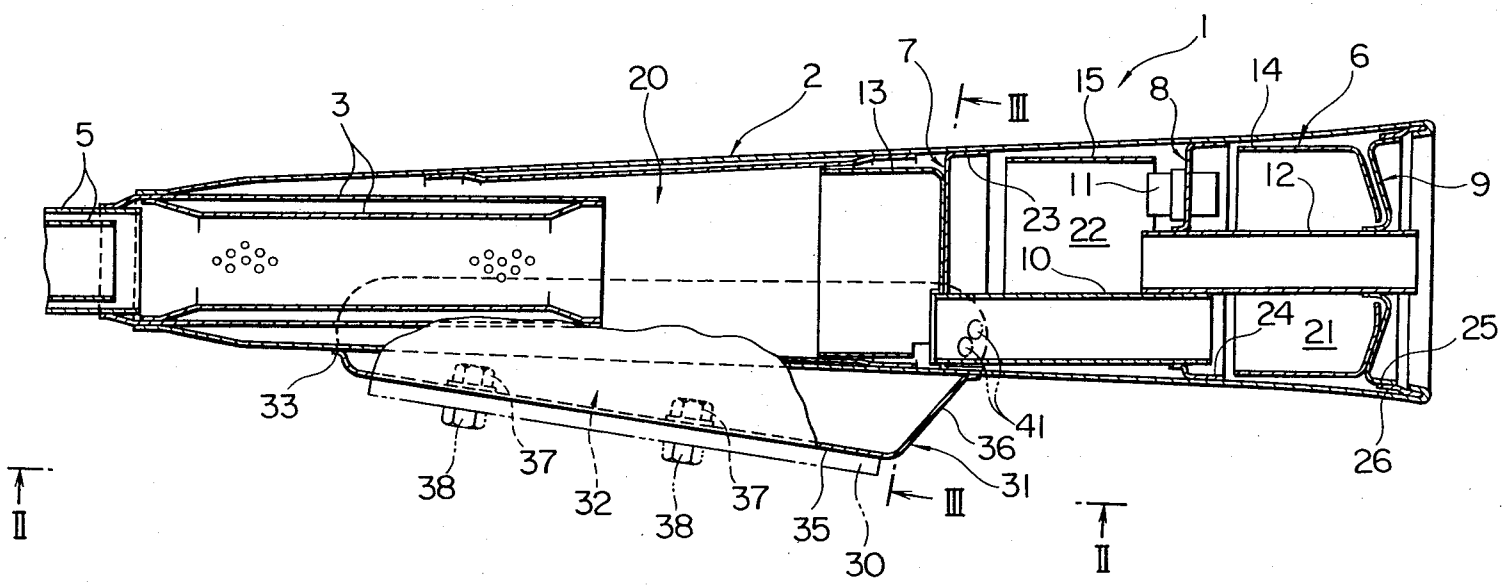
FIG. 1 is a sectional view showing an embodiment of the present invention embodied in a motorcycle.

In FIG. 1, a muffler 1 is provided with an outer cylinder 2 of the tapered form, and an exhaust gas draw tube 3 of the double-wall construction is engaged in the inner periphery of the smaller diameter end of the outer cylinder 2 and soldered or welded therewith. The draw tube 3 projects out beyond the end of the outer cylinder 2 slightly, and the projecting end of the draw tube 3 is engaged with the outer periphery of the outlet end of an exhaust pipe 5 and welded or soldered therewith. Although not shown in the drawings, the inlet end of the exhaust pipe 5 is connected to an exhaust manifold or exhaust ports of the engine through another exhaust pipe.

A baffle assembly 6 is provided in the interior of the downstream portion of the outer cylinder 2. The baffle assembly 6 is constituted by a plurality of protecting plates 13, 14, 15 and so on which form together a welded assembly. The baffle plates 7, 8, 9 are arranged longitudinally of the muffler 1 at positions spaced apart from each other. A first sound arresting chamber portion (an upstream side main sound arresting chamber portion) 20 is formed in the interior of the outer cylinder 2 at the upstream side of the baffle plate (the first partition) 7. A third and a second sound arresting chamber portion (downstream side main sound arresting portions) 22, 21 are formed between the baffle plates 7 and 8 and between the baffle plates 8 and 9, respectively. The baffle plates 7, 8, 9 are provided at their outer peripheries with cylindrical flanges 23, 24, 25, respectively, projecting toward the downstream side. These cylindrical flanges 23, 24, 25 are compressingly contacted with the inner surface of the outer cylinder 2 or a tapered cylindrical plate 26 at the downstream side of the outer cylinder 2, so that the baffle assembly 6 is fixedly secured to the outer cylinder 2 by virtue of these compressingly contacted portions.

The baffle tube 10 connects the first sound arresting chamber 20 to the second sound arresting chamber 21. The baffle tube 11 connects the second sound arresting chamber 21 to the third sound arresting chamber 22. The baffle tube 12 communicates the third sound arresting chamber 22 with the exterior of the muffler. The protecting plates 13, 14, 15 are for preventing the variation in color of the outer cylinder 2 due to the heat of the exhaust gas, and are provided with cylindrical portions located adjacent to the downstream portion of the first sound arresting chamber 20 and the outer peripheries of the second sound arresting chamber 21 and the third sound arresting chamber 22, respectively, so as to limit the transmission of heat of the exhaust gas to the outer cylinder 2.

A bracket 31 is located between the above described muffler and a bracket of the motorcycle (the body) 30. As is clear from FIGS. 1-3, the bracket 31 is a product formed by a pressing process having the form of an elongated bowl and it is open at the side facing the outer cylinder 2 and an auxiliary sound arresting chamber 32 is formed in the interior thereof. The bracket 31 extends along the outer cylinder 2 in the range from the upstream side of the outer cylinder 2 to a portion slightly downstream of the baffle plate 7.

The bracket 31 is provided with a peripheral wall 36 contiguous to the bottom wall 35 and the edge portion thereof. As shown in FIG. 1, nuts 37 are welded or soldered on the inner surface of the bottom wall 35 at two positions, for example, so that the bottom wall 35 can be fixedly secured to the bracket 30 at the side of the body of the motorcycle by means of bolts 38 threadedly engaged with the nuts 37. A flange 33 is formed on the edge portion of the peripheral wall 36 along the entire periphery, and the flange 33 is air-tightly secured to the outer surface of the outer cylinder 2 by a welding process.

Figure 2:
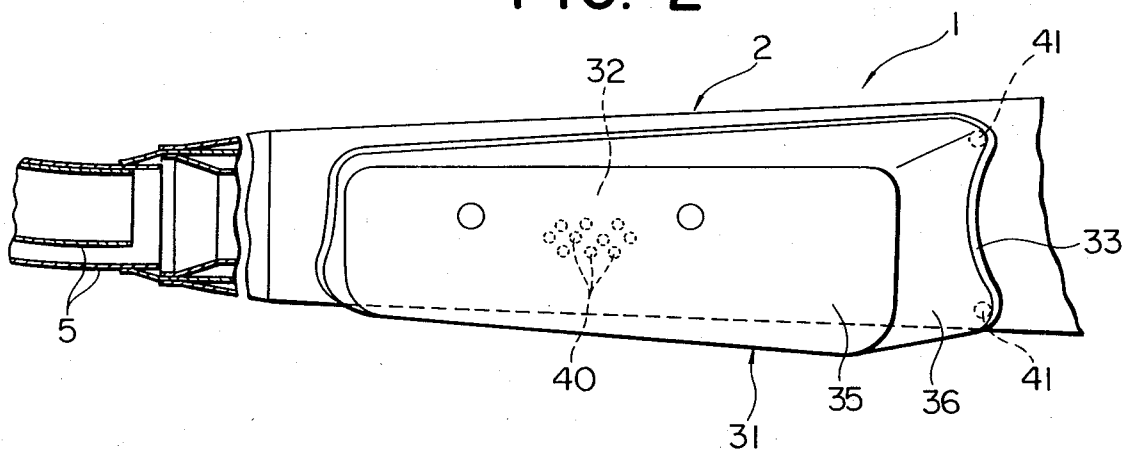
FIG. 2 is a fragmentary side view partly in section as seen in the direction of arrows II—II in FIG. 1.
Figure 3:
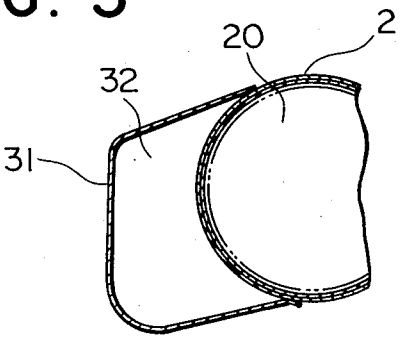
FIG. 3 is a fragmentary sectional view taken by the arrows III—III in FIG. 1.

As shown in FIG. 2, a portion of the outer cylinder 2 facing against the auxiliary sound arresting chamber 32 is formed substantially in its entire area with small diameter holes 40 (only partly shown in FIG. 2) at positions spaced a distance from each other, thereby communicating the auxiliary sound arresting chamber 32 solely with the first sound arresting chamber 20.

Plating liquid drain holes 41 are formed at two positions in the outer cylinder 2 in the area facing against the downstream end of the auxiliary sound arresting chamber 32. The plating liquid drain holes 41 are positioned adjacent to the two upper and lower corners at the downstream side of the peripheral wall 36. In the state in which the baffle assembly 6 is assembled in the muffler, as shown in FIG. 1, the plating liquid drain holes 41 are closed by the cylindrical flange 23 of the baffle plate 7.

The plating process using the above described plating liquid drain holes 41 is carried out as described below. The plating process is applied to the subassembly prior to the assembling of the baffle assembly 6, i.e., to the subassembly wherein the drawtube 3, the exhaust pipe 5 and the bracket 31 are secured to the outer cylinder 2, and the subassembly is successively dipped in various processing liquids wherein the outer cylinder 2 is hung down by supporting the tip of the exhaust pipe 5 (not shown) by a transporting device.

In this case, when the subassembly is pulled up from each processing liquid, the processing liquid remaining in the interior of the outer cylinder 2, the draw tube 3 and the exhaust pipe 5 is rapidly discharged therefrom through the opening of the lower end of the exhaust pipe 5 and returned to each original processing bath. The substantial amount of the processing liquid remaining in the auxiliary sound arresting chamber 32 is also returned to the original processing bath through the small diameter holes 40 and through the interior of the outer cylinder 2. The residual processing liquid remaining in the lower end of the auxiliary sound arresting chamber 32 is returned to the original processing bath through the plating liquid drain holes 41 and the interior of the outer cylinder 2. As described above, when the subassembly is pulled up from each processing liquid, all the processing liquid in the subassembly is rapidly discharged therefrom and returned to each original processing bath, and, therefore, mixing of one processing liquid with that of the succeeding process is positively prevented.

After the plating process is completed, the baffle assembly 6 is inserted into the interior of the outer cylinder 2 through the opening at the downstream side thereof, and is fixedly secured thereto as described previously. When the baffle assembly 6 is secured, the plating liquid drain holes 41 are closed by the cylindrical flange 23 of the baffle plate 7. Therefore, in the driving operation of the motorcycle described below, the exhaust gas is prevented from flowing through the plating liquid drain holes 41 thereby preventing the proper function of the muffler per se from being deteriorated.

The exhaust gas of the engine flows from the exhaust pipe 5 through the draw tube 3 into the first sound arresting chamber 20 and a part of the exhaust gas flows from the first sound arresting chamber 20 through the small diameter holes 40 into the auxiliary sound arresting chamber 32. Then, the exhaust gas flows through the baffle tube 10 into the second sound arresting chamber 21 and then through the baffle tube 11 into the third sound arresting chamber 22 and is discharged through the baffle tube 12 to the atmosphere. In this manner, the noise of the exhaust gas is arrested during the time it flows through the muffler 1 by virtue of the interference effect and the expansion of exhaust gas.

With the above described construction of the muffler, the sound arresting chambers are formed not only within the interior of the outer cylinder 2 but also in the interior of the bracket 31 located outside the outer cylinder 2 and attached to the bracket 30 of the body of the motorcycle, and the volume of the sound arresting chambers as a whole can be made exremely large. Therefore, the noise of the exhaust gas is sufficiently arrested and the output of the engine can also be kept high. In the construction as illustrated, since the auxiliary sound arresting chamber 32 communicates with the first sound arresting chamber 20 so that the substantial volume of the first sound arresting chamber 20 is increased, the output of the engine can be kept especially high.

Further, since the auxiliary sound arresting chamber 32 communicates with the first sound arresting chamber 20 through a plurality of small diameter holes 40, the interference effect and the expansion rate are made high thereby permitting the noise of the exhaust gas to be sufficiently arrested.

According to the present invention as described above, since the auxiliary sound arresting chamber 32 is formed in the interior of the bracket 31 so as to increase the volume of the sound arresting chambers as a whole, the output of the engine can be enhanced, while the sound arresting effect is improved.

Particularly, when the auxiliary sound arresting chamber 32 communicates with the first sound arresting chamber 20, the output of the engine can be greately enhanced. Further, by forming the bracket 31 from a bowl-shaped body, the strength of the bracket 31 can be made high.

According to the present invention, since the auxiliary sound arresting chamber 32 located in the interior of the bracket 31 communicates with the sound arresting chamber 20 located in the interior of the outer cylinder 2 through a plurality of small diameter holes 40, the effect of enhancing the output of the engine and the effect of arresting the noise of the exhaust gas can be achieved by the auxiliary sound arresting chamber 32, while the sound arresting effect is achieved by virtue of the plurality of the small diameter holes 40. It may be conceivable to provide a single large diameter opening in the outer cylinder 2 in place of the plurality of small diameter holes 40. However, provision of the plurality of small diameter holes 40 makes it easier in comparison with the case of providing a single large diameter opening to carry out rolling operation of the raw material for forming the outer cylinder 2 and the welding operation of the formed parts, because the local deterioration in the strength of the outer cylinder can be avoided in case the plurality of small diameter holes are provided.

According to the present invention, since plating liquid drain holes 41 are provided in communication with the auxiliary arresting chamber 32, the processing liquid is prevented from being left in the auxiliary sound arresting chamber 32 during the plating process thereby preventing the various processing liquid from being mixed with each other while the deterioration of the plating liquids due to mixing of the processing liquids can be effectively prevented. Further, since the plating liquid drain holes 41 are blocked by the baffle member (the cylindrical flange 23 of the baffle plate 7, for example, the proper function of the muffler is not deteriorated by the provision of the plating liquid drain holes 41. Further, since the baffle member is used as a member for blocking the plating liquid drain holes 41, a number of the parts and the weight thereof can be reduced in comparison with the case in which exclusive closing members are used in blocking the plating liquid drain holes.

We claim:

1. A muffler for an internal combustion engine comprising a cylinder having fluid flow inlet and outlet means, a main sound arresting chamber within said cylinder and a bracket fixedly secured to an outer surface of said cylinder and having a peripheral wall provided with mounting means, the improvement comprising means for partitioning the main sound arresting chamber into an upstream main sound arresting chamber portion and a downstream main sound arresting chamber portion, said bracket being sealingly secured at a peripheral portion thereof to a wall portion of said cylinder coinciding with the upstream main sound arresting chamber portion to define an auxiliary sound arresting chamber therebetween, and means for fluid communication between said auxiliary sound arresting chamber and the upstream portion of said main sound arresting chamber provided in said wall portion of said cylinder coinciding with the upstream main sound arresting chamber portion.

2. Muffler according to claim 1, wherein said bracket is in the form of a bowl-shaped body open at the side facing the outer surface of the cylinder.

3. A muffler according to claim 1 wherein said fluid communication means comprise holes provided in said wall portion of said cylinder coinciding with the upstream main sound arresting chamber.

4. Muffler according to claim 3 wherein said bracket is in the form of a bowl-shaped body open at the side facing the outer surface of the cylinder.

5. A muffler for an internal combustion engine comprising a cylinder having fluid flow inlet and outlet means, a main sound arresting chamber within said cylinder and a bracket fixedly secured to an outer surface of said cylinder and having a peripheral wall provided with mounting means, the improvement comprising means for partitioning the main sound arresting chamber into an upstream main sound arresting chamber portion and a downstream main sound arresting chamber portion, said bracket being sealingly secured at a peripheral edge portion thereof to a wall portion of said cylinder coinciding with the upstream main sound arresting chamber portion to define an auxiliary sound arresting chamber therebetween, and a plurality of small diameter holes in said wall portion of said cylinder coinciding with the upstream main sound arresting chamber within said peripheral edge portion of said bracket for fluid communication between said auxiliary sound arresting chamber and the upstream portion of said main sound arresting chamber provided in said wall portion of said cylinder coinciding with the upstream main sound arresting chamber portion.

6. A muffler according to claim 5 wherein said holes are coextensive with said wall portion of said cylinder coinciding with the upstream main sound arresting chamber within said peripheral edge portion of said bracket.

7. A muffler for an internal combustion engine comprising a cylinder having fluid flow inlet and outlet means, a main sound arresting chamber within said cylinder and a bracket fixedly secured to an outer surface of said cylinder, the improvement comprising means for partitioning the main sound arresting chamber into an upstream main sound arresting chamber portion and a downstream main sound arresting chamber portion, said bracket being sealingly secured at a peripheral portion thereof to a wall portion of said cylinder coinciding with the upstream main sound arresting chamber portion to define an auxiliary sound arresting chamber therebetween, means for fluid communication between said auxiliary sound arresting chamber and the upstream portion of said main sound arresting chamber provided in said wall portion of said cylinder coinciding with the upstream main sound arresting chamber portion, and plating liquid drain holes provided in a wall portion of the cylinder at an end of said auxiliary sound arresting chamber, said plating liquid drain holes being blocked by a baffle member located within said cylinder.

8. Muffler according to claim 7, wherein said plating liquid drain holes communicate with the downstream portion of the auxiliary sound arresting chamber, and the baffle member blocking said plating liquid drain holes is a baffle plate forming a partition within the cylinder.

* * * * *